United States Patent [19]

Ortega

[11] Patent Number: 4,718,195

[45] Date of Patent: Jan. 12, 1988

[54] APPARATUS FOR MAINTAINING A DOOR IN ALIGNMENT WITH FRAME DURING SHIPPING AND INSTALLATION

[76] Inventor: Diego Ortega, P.O. Box 8, Jeanerette, La. 70544

[21] Appl. No.: 909,672

[22] Filed: Sep. 22, 1986

[51] Int. Cl.[4] ..... E06B 1/00

[52] U.S. Cl. ..... 49/380

[58] Field of Search ..... 49/380; 206/325

[56] References Cited

U.S. PATENT DOCUMENTS

| | | | |
|---|---|---|---|
| 2,720,308 | 10/1955 | Howell, Jr. | 49/380 X |
| 3,205,982 | 9/1965 | Chimienti | 49/380 X |
| 3,216,066 | 11/1965 | Hadacek | 49/380 X |
| 3,250,039 | 5/1966 | Strutin | 49/380 |
| 3,411,240 | 11/1968 | Groat | 49/380 |
| 3,430,385 | 3/1969 | Biro | 49/380 |
| 3,593,458 | 7/1971 | Wahlfeld | 49/380 |
| 4,483,101 | 11/1984 | Berzina | 49/380 |

OTHER PUBLICATIONS

Advertising flyer by Endura Company, entitled "Endura's Door Frame Alignment Bracket".

*Primary Examiner*—Philip C. Kannan

*Attorney, Agent, or Firm*—Pravel, Gambrell, Hewitt, Kimball & Krieger

[57] ABSTRACT

A first bracket which is threadably engaged into the recess of the door lock in the face of the door, having a lip portion for receiving a tab thereinto; a second bracket threadably mounted into the recess on the jamb portion of the door, the bracket having a tab portion extending outwardly therefrom. In the use of the apparatus, the door is then moved to the closed position with the tab on the second bracket slidingly engaged into a slot within the first bracket, so that when the tab is manually bent into a position substantially parallel with the door, the door is maintained in the closed position. Upon completion of installation, the tab is straightened to its original position and the door is free to open.

7 Claims, 7 Drawing Figures

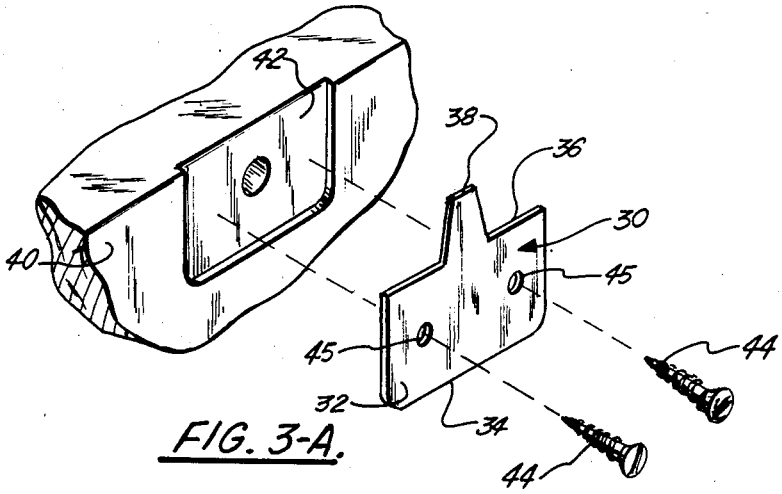
FIG. 3-A.
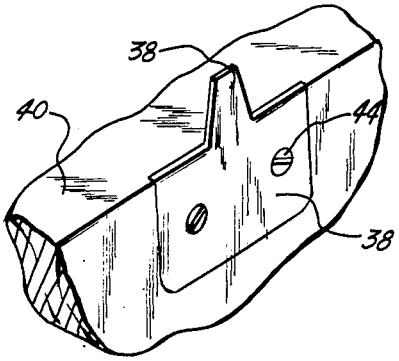
FIG. 3-B.
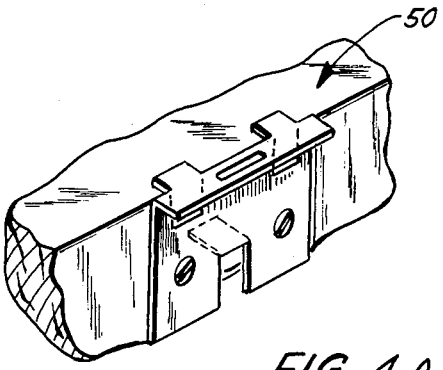
FIG. 4-A.
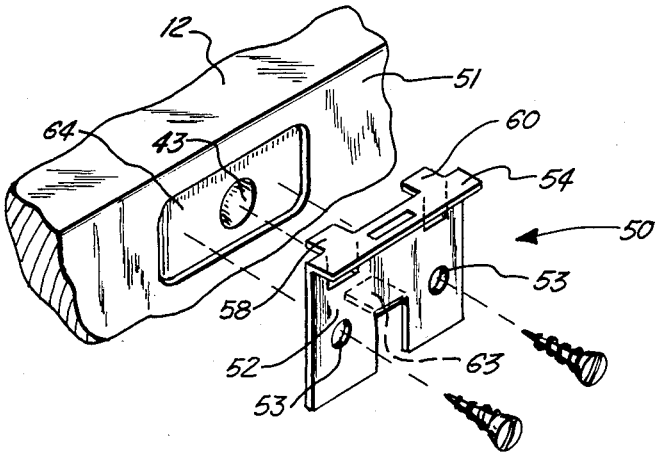
FIG. 4-B.

APPARATUS FOR MAINTAINING A DOOR IN ALIGNMENT WITH FRAME DURING SHIPPING AND INSTALLATION

BACKGROUND OF THE INVENTION

1. Field of the Invention

The apparatus of the present invention relates to doors and door frames. More particularly, the present invention relates to an apparatus for maintaining a door aligned in the closed position within a door frame during shipment and installation of the door and door frame.

2. General Background

In the construction of homes or other types of buildings, wooden doors are normally purchased and installed in a preconstructed frame so that the door fits properly within the frame in the construction of the structure. It is required, therefore, that the door and door frame be assembled as a package in a factory or the like, and be transported to the destination where the door and the frame will be ultimately utilized in the structure. In the transport of this assembled package, it would be beneficial that the door be maintained in the closed position within the frame, so that the frame and the door undergo a minimum of warping and twisting during the shipment, and of course, to protect the surface of the door from being in contact with foreign objects should it be allowed to swing freely on its hinges.

An additional problem confronted in the art is the type of door frame which is known as a split jamb type, wherein upon completion of shipment, and installation, the door jamb is separated into the interior and exterior faces of the door frame, for installation. However, once the split jamb has been separated for installation, the fact that it only includes an upper cross member secured to the two vertical members, in most cases which are quite lengthly, have no base support therefore, the vertical members are easily movable and can be misaligned quite easily if the door is not secured in the closed position. Therefore, unless a means is in place to maintain the door in the closed position, several men are required in order to properly align the door frame for placement in the structure.

In the present state of the art, in the construction industry, one of the most common ways of assuring that the door is maintained in the closed position, is simply to drive several nails through the frame into the front edge of the door so that the door is therefore disallowed from swinging open. Of course, this becomes a problem since upon arrival at a destination, these nails must be removed from the frame prior to installation in the rough opening so that the door may of course swing open. Therefore, upon removal of the nails, blemishes are left on the frame, and more importantly, this would leave the door in a free swinging position wherein three frame members become floppy and awkward to handle as was discussed earlier. In addition, the front edge of the door and the frame must then be covered up and restored.

There are several patents which have been granted on the subject of a means for retaining prehung doors, the most pertinent being as follows:

U.S. Pat. No. 4,483,101 issued to Berzina, entitled "Retaining Strap For Prehung Doors", relates to an elongated strap member constructed of flexible material including a lateral projection extending outwardly from one side of the strap member with the material adapted with a staple driven therethrough. The strap member includes a projection insertable into the lock body bore of the door and the end of the strap deflected across one side surface of the door between the lock body door and the free swinging edge of the door.

U.S. Pat. No. 3,593,458 issued to Wahlfeld, et al, entitled "Shipping Door Lock", relates to an axle board dial rod placed within the latch opening and secured by a release fastener inserted at the lock opening longitudinally through the dial where they are locked by screw through the door jamb, preferably by a speed nut.

U.S. Pat. No. 3,411,240 issued to Groat, entitled "Door Assembly", relates to an assembly wherein a pair of door frames are connected along the outer edges to door casing transverse member connects the lower ends of the door frames so the door is held in space relation to the transverse member by a door support.

U.S. Pat. No. 3,216,066 issued to Hadacek, entitled "Pre-Hung Door Assembly", relates to a prehung metal door and casing assembly having a retaining means for retaining the door in the casing during shipping, the retaining means comprising a shear pin extending across the space between the door and the casing having the first end of the shear joint to the jamb portion and the second end joint to the edge of the door.

U.S. Pat. No. 3,584,416 issued to Baungartel, entitled "Pre-Hund Door Mounting Means", relates to a spacer element that extends across the entire thickness of the door frame to separate the door frame from its Z-bar. The spacer element is a single unit comprised of two extending projecting portions in a recessed connecting base portion.

U.S. Pat. No. 3,430,385 issued to Biro, entitled "Unitary Prehung Door Frame", relates to a prehung door and permanently attached frame having its lintel and jamb frame sections secured in overlying relation to embrace the door in operative relation and position the door face in the plane with the marginal faces of the frame. The free jamb section of the frame is secured to the swinging edge of the door before shipment by a spacer which is clipped or screwed between the door edge and the jamb adjacent to the bottom.

U.S. Pat. No. 2,728,956 issued to Jackson, entitled "Method and Preassemblied Casing For Finishing A Rough Door Opening", relates to preassembled door casing adapted for installation and a bracing means to prevent damage of the casing during shipment before installation.

U.S. Pat. No. 2,927,352 issued to Chenoweth, entitled "Prefabricated Door And Door Frame Unit", and U.S. Pat. No. 3,250,039 issued to Strutin, relates to a temporary securing means for prehung door, particularly for aluminum extrusions intergrally forming appropriate ribs or flanges on the extruded section.

Therefore, there is a need for a means or apparatus for maintaining a door in the closed position within a door jamb or frame during installation of the frame so that the frame does not become misaligned and awkward to handle. The particular type of frame that the present invention will address is the type of frame wherein there is included the trim already in place on the door frame when it is placed into position. Therefore, with the trim in place it precludes the use of any type of fixture that could be temporarily placed onto the frame and in the door which would maintain the door in the closed position, because it would blemish the trim already in place. Therefore, the present invention solves these problems quite readily.

SUMMARY OF THE PRESENT INVENTION

The apparatus of the present invention solves the problems in the art in a simply and straightforward manner. What is provided is an apparatus for assuring that a door hung within a casing is maintained in the closed position within the confines of the casing during shipment and installation. What is provided is an apparatus for assuring that a door hung within a casing is maintained in the closed position, the proper spacings are maintained, and alignment of the surfaces are maintained, during shipment and particularly during installation. What is provided is a first bracket which is threadably engaged into the recess of the door lock bore in the face of the door, having a lip portion for receiving a tab thereinto; a second bracket threadably mounted into the recess on the jamb portion of the door, the bracket having a tab portion extending outwardly therefrom. In the use of the apparatus, the door is then moved to the closed position with the tab on the second bracket slidingly engaged into a slot within the first bracket, so that when the tab is manually bent into a position substantially parallel with the door, the door is maintained in the closed position. Upon completion of installation, the tab is straightened to its original position and the door is free to open.

Therefore, it is a primary object of the present invention to provide a means for maintaining a door contained in the closed position within a door frame or casing wherein the trim on the door frame is already in place during shipment and installation;

It is a further principal object of the present invention to provide a means for maintaining a door closed within a door frame during shipment and installation to assure accurate spacing in squarness of the frame, the means insertable into the door lock recess and door jamb respectively for easy alignment;

It is a further object of the present invention to provide an apparatus for maintaining a door in the closed position during shipment and installation which is easily attachable to the door and to the door jamb, and upon removal after the door unit has been installed, leaves no outward signs of having been in place during the shipment process.

It is still a further object of the present invention to simplify and speed up the securing of a door within a door frame during shipment and installation, and to simplify the removal of the apparatus after the door has been installed.

BRIEF DESCRIPTION OF THE DRAWINGS

FIGS. 3A and 3B illustrate the tab portion of the apparatus of the present invention installed into a door jamb;

FIGS. 4A and 4B illustrate the tab engaging portion of the apparatus being installed into the face of a door.

DETAILED DESCRIPTION OF THE PREFERRED EMBODIMENT

Figure 2:
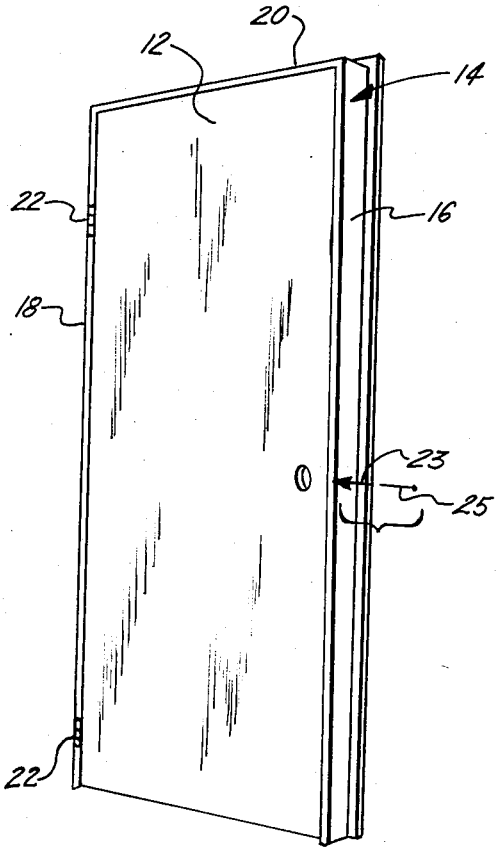
FIG. 2 is an overall view of a door within a door casing illustrating a standard state of the art means of maintaining the door in the closed position.
Figure 1:
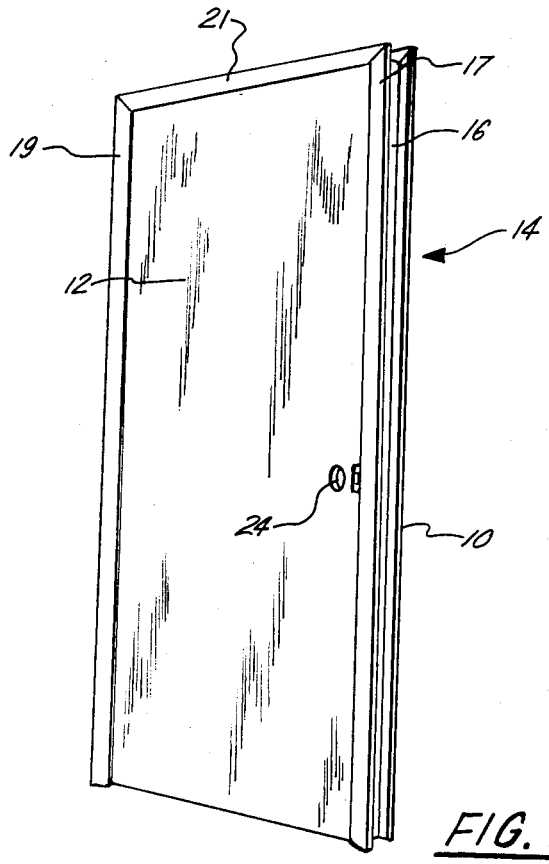
FIG. 1 is an overall view of a door contained within a door casing.

The apparatus of the present invention is illustrated in particular in FIGS. 3A–5 of the drawings by the numeral 10. Prior to a discussion of the apparatus, reference shall be made to FIGS. 1 and 2, which illustrate the standard door within a door frame of the type that will be discussed. As seen in FIGS. 1 and 2, there is illustrated a door, particularly of the wooden type 12, which is a standard door contained within a door frame or casing 14, the frame or casing having vertical side frame portions 16 and 18 and top portion 20 for defining the entire casing 14. Door 12 as seen in the FIGURES is attached to the right most vertical portion 18 via hinges 22 for opening and closing from there within. As is well known in the art, the frame 14 would simply be installed within a home or building under construction, and would be fastened via nails to the surrounding studs or frame of the building so that the door is "pre-hung" within the frame.

As particularly in FIG. 1, door frame 14, when it arrives from shipment is of the type having as was discussed earlier, vertical side portions 16 and 18 and top portion 20 for providing the frame work in which door 12 is hung. To facilitate easy placement into the space, frame 14 also has exterior trim vertical members 17 and 19 and upper cross member 21 on both faces of the door frame 14 so that once the frame is placed into position the trim is already in place. It should be noted that this particular type of frame noted in FIG. 1 is of the type termed a "split jamb" type wherein the frame comes apart into two faces of the frame that are reassembled once in place on the wall.

In FIG. 2, for purposes of illustration, there is illustrated a standard manner in which a door, during shipment and installation may be fastened or held in the closed position. As indicated by nail member 25, nail member 25 is driven through face 16 in the direction of Arrow 23 and is secured into the edge of the door in order to maintain the door in the closed position during shipment. However, upon arrival of the door and door frame at its destination, nail 25 must be removed prior to installation or access to the nail 25 cannot be had. When nail 25 is removed, door 12 is allowed to swing to the open position, and frame 14 becomes very wabbley and misaligned and very difficult to install. Therefore, as seen in FIG. 1, apparatus 10 has been installed in place in door 12 and frame 14 and door 12 is maintained in the closed position. Apparatus 10 will be discussed in detail as follows.

Reference is now made to FIGS. 3A–5 which illustrates the apparatus of the present invention in maintaining a door in the closed relative position during shipment and installation as seen in FIGS. 1 and 2, but without the need for nail 25 to secure it in place as seen in FIG. 2. What is provided is, as seen in FIG. 3A, a first bracket portion 30 which comprises a substantially rectangular body portion 32 having a rear edge 34 and a front edge 36, front edge 36 leading into a centrally located tab member 38 which is intergral to the body portion 32 and forms a tab extending outwardly from the front edge 36 as seen in the FIGURE. For purposes of illustration, there is further illustrated a portion of the door jamb 40 which is seen more complete in FIG. 5, wherein the door jamb 40 would house, once installed, the strike plate for receiving the door lock in a finished home. Normally, the strike plate which would receive the door lock, would be housed in the recessed area 42 as seen in jamb 40, so that the bracket thickness would be substantially flush with the face of jamb 40 so that the door 12 would close within the frame without any obstructions. This recessed area 42 is pertinent in the present invention, since when bracket 30 is installed within jamb 40, bracket 30 is substantially the exact size of the strike plate and therefore would fit into recessed area 42 and held in place via screws 44 through holes 45 secured into the recessed area 42 as seen in FIG. 3B. For purposes of construction, bracket 30 would preferably be constructed of a metal which could be a pliable type metal the reason for which will be discussed further.

Turning now to the second portion of apparatus 10, there is further included a second mounting bracket 50 as seen in FIG. 4A. In FIG., 4B, mounting bracket 50 is seen positioned and secured to the face 51 of door 12 for use. Bracket 50 as seen in the drawing comprises a substantially rectangular body portion 52 with a pair of screw holes 53 bored therethrough for securing to the face 51 of door 12. Bracket 50 further includes a outwardly depending lip portion 54 which is contained along its front edge, lip portion 54 having a slot 56 through its center portion for receiving tab 38 therethrough during use of the apparatus as will be explained further. Further, there is included a pair of tabs 58 and 60 for securing the face of bracket 50 in position on door 12 as seen in FIG. 4A. Further there is included an additional 3rd tab 62 as seen in phantom view in FIG. 4B which inserts into recess 43 of door 12 which accomplishes that same function. For purposes of illustration, as seen in FIG. 4B, bracket 50 would be secured directly in position over recessed area 64 which would house the lock mechanism of door 12 once door 12 has been installed. Following installation of bracket 50 via screws 66 into door 12, the bracket is in position as seen in FIG. 4A and ready for use in conjunction with bracket 30.

Figure 5:
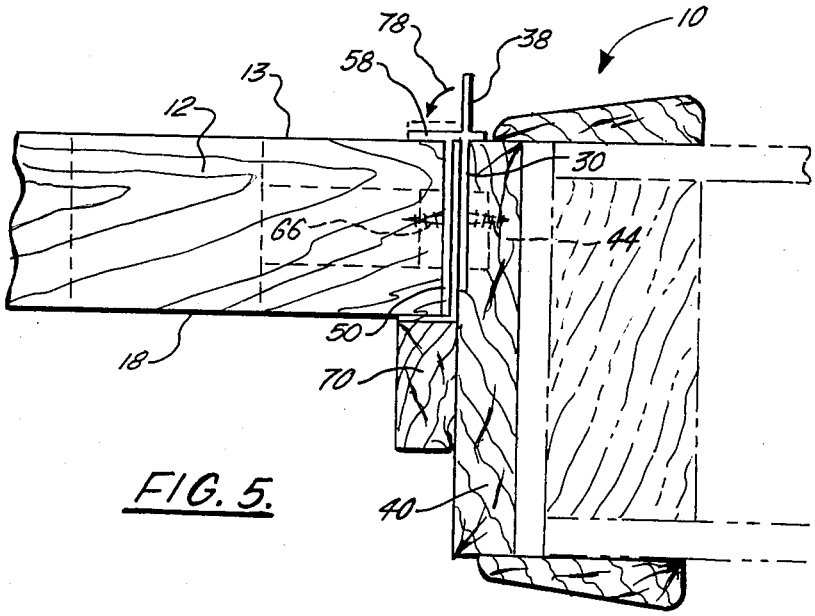
FIG. 5 illustrates a top view of the apparatus secured to the door jamb and the door for use during shipment and installation.

FIG. 5 illustrates the functioning of the apparatus during use. As seen in the FIGURE there is illustrated in top view door 12 that has been moved into the closed position against the stop 70 and adjacent to vertical door jamb 16. As seen in the FIGURE, door jamb 40 has secured thereto bracket 30 held in place via screws 44 with the tab member 38 extending therefrom. Likewise, door 12 has attached to it bracket 50 secured by screws 66 with tab portions 58 and 60 secured onto the face 51 of door 12, and tab 62 secured within the space 43 of door 12.

In view of the fact that bracket 30 is aligned in the lock bracket recess 42, and bracket 50 is aligned over the lock mechanism recess 64 of door 12, brackets 30 and 50 are therefore aligned in the proper positions so that when door 12 is placed in the closed position as seen in FIG. 5, tab 38 is aligned directly into slot 56, and in the closed position tab 38 is therefore extending therethrough. Following the closing of door 12 in the closed position, tab 38 is bent in the position as seen by Arrow 78 so that it is substantially parallel with tabs 58 and 60 (in phantom view), and therefore door 12 is held in position until tab is replaced to the position as seen in FIG. 5, and door 12 can be reopened.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for maintaining an interior door in the closed position in a preassembled mounting frame including a pair of vertical members, the apparatus, comprising:

a. a first bracket means secured to the door jamb;

b. a second bracket means secured to the free swinging face of the door; and c. means contained within the first bracket means for slidably engaging the second bracket means, and upon moving the engaging means to an angular position secures the door in the closed position, and maintains the vertical members of the mounting frame in a substantially vertical position.

2. The apparatus of claim 1, wherein the first bracket means comprises a bracket positionable onto the face of the door jamb at the strike plate mortise having a tab extending outwardly therefrom.

3. The apparatus in claim 1, wherein the second bracket means comprises a bracket positionable onto the face of the door further including a lip portion having a slot therein for receiving a tab of the first bracket means.

4. The apparatus in claim 3, wherein the first and second bracket means are rigidly engaged on the door and jamb so that the tab of the first bracket means is secured within the slot in the second bracket means.

5. The apparatus of claim 3, wherein the tab, to be secured into the slot of the second bracket means is bent to a second position for disallowing movement of the door to the open position.

6. An apparatus for maintaining a door hinged in a preassembled mounting frame, being maintained in the mounting frame during shipping and installation, the door comprising:

a. a first bracket mounted onto the jamb portion of the frame, further comprising a tab member extending outwardly therefrom;

b. a second bracket mounted onto the face of the door, further comprising a lip portion having a slot therewithin, the slot being of identical height as the tab member of the first bracket; and c. means for securing the door in the closed position following the tab of the first bracket being inserted into the slot of the second bracket and positioned at an angle so that it cannot be removed from the slot.

7. An apparatus for maintaining an interior door hinged in a preassembled mounting frame, the frame having exterior molding around the door opening, the apparatus being maintained in the mounting frame during shipping and installation, and comprising:

a. a first bracket mounted on the jamb portion of the frame, further comprising a tab member extending outwardly therefrom;

b. a second bracket mounted onto the face of the door, further comprising a lip portion having a slot therewithin, the slot engaging the tab member as the door is placed in the closed position; and c. means for securing the door in the closed position following the tab of the first bracket being inserted into the slot of the second bracket and positioned at an angle so that it cannot be removed from the slot, and maintains the door in the closed position, and disallows outward movement of the lower portion of the frame during shipping and installation of the frame.

* * * * *